US008258195B2

(12) United States Patent
Kibby et al.

(10) Patent No.: US 8,258,195 B2
(45) **Date of Patent: *Sep. 4, 2012**

(54) ACETYLENE ENHANCED CONVERSION OF SYNGAS TO FISCHER-TROPSCH HYDROCARBON PRODUCTS

(75) Inventors: Charles L. Kibby, Benicia, CA (US); Minquan Cheng, Katy, TX (US); Yun Lei, Sydney (AU); David Lawrence Trimm, Watsons Bay (AU); William L. Schinski, San Rafael, CA (US)

(73) Assignees: Chevron U.S.A. Inc., San Ramon, CA (US); Commonwealth Scientific and Industrial Research Organisation, Campbell (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/421,601

(22) Filed: Mar. 15, 2012

(65) Prior Publication Data

US 2012/0172459 A1 Jul. 5, 2012

Related U.S. Application Data

(63) Continuation of application No. 12/342,978, filed on Dec. 23, 2008, now Pat. No. 8,163,808.

(60) Provisional application No. 61/018,272, filed on Dec. 31, 2007.

(51) Int. Cl.
*C07C 27/00* (2006.01)

(52) U.S. Cl. ..... 518/700

(58) Field of Classification Search ..... 518/700
See application file for complete search history.

(56) References Cited

U.S. PATENT DOCUMENTS

| | | | |
|---|---|---|---|
| 4,726,913 | A | 2/1988 | Brophy et al. |
| 5,824,834 | A | 10/1998 | Bachtler et al. |
| 7,208,647 | B2 | 4/2007 | Peterson et al. |

OTHER PUBLICATIONS

Gerald P. Huffman, "C1 Chemistry for the Production of Ultra-Clean Liquid Transportation Fuels and Hydrogen," *Consortium for Fossil Fuel Science*, Technical Final Report, pp. 1-10 (Apr. 10, 2006), DOE Contract No. DE-FC26-02NT41594.

K.G. Marnasidou et al., "Catalytic partial oxidation of methane to synthesis gas in a pilot-plant-scale spouted-bed reactor," *Chemical Engineering Science* 54:3691-3699 (1999).

Gerald P. Huffman, "C1 Chemistry for the Production of Clean Liquid Transportation Fuels and Hydrogen," *Consortium for Fossil Fuel Science*, Annual Report (May 1, 2001-Sep. 30, 2002), 20 pages, DOE Contract No. DE-FC26-99FT40540.

Gerald P. Huffman, "C1 Chemistry for the Production of Ultra-Clean Liquid Transportation Fuels and Hydrogen," *Consortium for Fossil Fuel Science*, Semi-annual six-month report (Oct. 1, 2004-Mar. 31, 2005), 12 pages, DOE Contract No. DE-FC26-02NT41594.

Irving Wender et al., "Chain Growth in Fischer-Tropsch: Cobalt versus Iron," *Department of Chemical and Petroleum Engineering University of Pittsburgh*, CFFS Annual Meeting, Roanoke, WV, Aug. 1-4, 2004, 26 pages.

Y. Zhang et al., "Probing Fischer-Tropsch Synthesis with Acetylenic Molecules," *Department of Chemical and Petroleum Engineering University of Pittsburgh*, CFFS Annual Meeting, Roanoke, WV, Jul. 31-Aug. 3, 2005, 20 pages.

Yulong Zhang et al., "Acetylenes as Probes in the Fischer-Tropsch Reaction," *Prepr. Pap.-Am. Chem. Soc. Div. Fuel Chem.* 48(2):731-732 (2003).

Yulong Zhang et al., "Acetylenes as Probes in the Fischer-Tropsch Reaction," *Topics in Catalysis* 32(3-4): 125-133 (2005).

Yulong Zhang et al., "Addition of Acetylene to the Fischer-Tropsch Reaction," *Energy & Fuels* 21:640-645 (2007).

Zhong Zhou et al., "Hybrid zirconia catalysts for conversion of Fischer-Tropsch waxy products to transportation fuels," *Fuel Processing Technology* 83:67-80 (2003).

David Trimm et al., "Oxygenated fuel additives: The formation of methyl ether and 1,1-dimethoxyethane by the catalysed reaction of acetylene with methanol," *Catalysis Today* 145:163-168 (2009).

G.A. Huff et al., "Oxidative pyrolysis of natural gas in a spouted-bed reactor : reaction stoichiometry and experimental reactor design," *Catalysis Today* 46:223-231 (1998).

K.L. Hohn et al., "Methane coupling to acetylene over Pt-coated monoliths at millisecond contact times," *Catalysis Letters* 54:113-118 (1998).

Li Hou, "Fischer-Tropsch Studies with Acetylenic Compounds as Probes," Dissertation, University of Pittsburgh School of Engineering, Feb. 10, 2005, 170 pages.

Iem, Khlebnikova, Lapidus, "Effect of the Addition of Acetylene on the Synthesis of Hydrocarbons from CO and H2 in the Presence of Cobalt Catalysts", *Russian Chemical Bulletin*, vol. 33, No. 2, Feb. 1984, pp. 329-333, Plenum Publishing Corporation.

Pyatnitskii, Orlik, Nesterova, Ostanyuk, Gurushin, Hydrogenation of CO and Acetylene a Fused Iron Catalyst at Atmospheric Pressure, *Theoretical and Experimental Chemistry* vol. 26, No. 5, Sep. 1991, pp. 580-583, Plenum Publishing Corporation.

Zhang, Hou, Tierney, Wender, "Addition of Acetylene to the Fischer-Tropsch Reaction", *Energy and Fuels*, vol. 21 (2007), pp. 640-645, American Chemical Society Published.

*Primary Examiner* — Jafar Parsa
(74) *Attorney, Agent, or Firm* — Merchant & Gould

(57) ABSTRACT

A method is disclosed for converting syngas to Fischer-Tropsch (F-T) hydrocarbon products. A synthesis gas including carbon monoxide and hydrogen gas is provided to a F-T reactor. Also, acetylene is supplied to the F-T reactor. The ratio of the volume of acetylene to the volume of synthesis gas is at least 0.01. The synthesis gas and acetylene are reacted under suitable reaction conditions and in the presence of a catalyst to produce F-T hydrocarbon products. The F-T hydrocarbon products are then recovered from the reactor. The synthesis gas and acetylene may be provided in a combined feed stream or introduced separately into the reactor. The acetylene enhanced syngas conversion in a F-T reactor results in the synthesis of F-T products which have a tighter distribution of intermediate length carbon products than do F-T products synthesized according to conventional methods.

20 Claims, 7 Drawing Sheets

Head - to - head compare

| Run # | 1 | 2 |
|---|---|---|
| $C_2H_2$ in Feed | NO | YES |
| Degree of Conversion Oil Products | High Waxy | High Clear |

5 atm.
210°C
1.61% $C_2H_2$

| | $CO_2$ | $C_1+C_2$ | $C_3-C_4$ | $C_5-C_9$ | $C_{10}-C_{20}$ | $C_{21}+$ |
|---|---|---|---|---|---|---|
| FT-0%$C_2H_2$ | 0.68 | 15.93 | 13.21 | 27.37 | 34.16 | 8.63 |
| FTA-1.55%$C_2H_2$ | 0.76 | 11.31 | 23.37 | 30.49 | 21.88 | 12.18 |
| FTA-3.25%$C_2H_2$ | 0.67 | 18.41 | 35.66 | 30.59 | 12.98 | 1.69 |
| FTA-3.8%$C_2H_2$ | 0.68 | 14.95 | 31.36 | 33.41 | 17.36 | 2.26 |

ACETYLENE ENHANCED CONVERSION OF SYNGAS TO FISCHER-TROPSCH HYDROCARBON PRODUCTS

This application claims priority to U.S. patent application Ser. No. 12/342,978 filed Dec. 23, 2008, which claims benefit of U.S. Provisional Application Ser. No. 61/018,272, filed Dec. 31, 2007, the contents of both of which are incorporated herein by reference in their entirety.

TECHNICAL FIELD

The present invention relates generally to converting carbon containing products, such as natural gas, to liquid hydrocarbons or fuels, and more particularly, to methods for catalytically converting synthesis gas or "syngas" (carbon monoxide (CO) and hydrogen ($H_2$)) into hydrocarbon products utilizing Fischer-Tropsch (F-T) reactions.

BACKGROUND

It is often desirable to convert solid or gas carbon-containing products into hydrocarbon liquids using Fischer-Tropsch reactions. For example, the carbon based product might be coal, biomass or natural gas. These starting products are converted in a syngas generator to a synthetic gas, hereinafter referred to as "syngas", which contains carbon monoxide (CO) and hydrogen ($H_2$) gases. The syngas is then converted in a Fischer-Tropsch reactor, typically in the presence of an iron or cobalt based catalyst and under suitable temperature and pressure conditions, into hydrocarbon products and other effluents. These hydrocarbon products are usually widely distributed in carbon chain length ($C_1$-$C_{100+}$). At temperatures of approximately 22° C. and at atmospheric pressure, these produced hydrocarbon products include significant quantities of gas ($C_1$-$C_4$), liquid ($C_5$-$C_{20}$) and waxy ($C_{20+}$) products. These designations of chain length for gas, liquid and waxy (solids) products are, of course, also dependent upon the relative branching of the hydrocarbon chains of the products and other known factors.

Conventional F-T synthesis of hydrocarbon products has several shortcomings. First, the synthesis is not particularly selective and can generate the wide range of hydrocarbon products having carbon chain lengths of $C_1$ to $C_{100+}$. Light hydrocarbons of very short chain lengths often need recycling and further processing in the F-T reactor to produce more desirable medium chain length hydrocarbons. Alternatively, these light gases can be burned as fuel to produce heat. Hydrocarbons having chain lengths in the upper end of this chain range, in general from $C_{21}$ to $C_{100+}$, are considered to be waxy rather than liquid at the above described temperature of 22° C. and 1 atmosphere of pressure. Often hydrocracking is required to break these long chain length hydrocarbons down into shorter, less viscous and more desirable liquid hydrocarbon products. However, in some locations, such as on offshore oil and gas producing platforms, it is undesirable to locate hydrocracking facilities due to weight, space and economic limitations. Thus using conventional F-T conversion processes on an offshore platform is less than desirable. Also, in remote land locations, it may be undesirable to include a hydrocracking unit as the addition of this unit raises the capital and operating expenses associated with F-T production of hydrocarbon products.

Another shortcoming in conventional F-T conversions is that significant amounts of methane are produced. A further shortcoming is that a rather limited amount of carbon monoxide within the syngas is converted in each pass through a F-T reactor. The present invention addresses these shortcomings in traditional F-T syntheses which typically include production of substantial amounts of methane and other short chain gaseous hydrocarbon products along with substantial amounts of long chain, waxy hydrocarbon products while converting carbon monoxide in a syngas to hydrocarbon products at a relatively low conversion rate.

SUMMARY OF THE INVENTION

A method is disclosed for converting syngas to Fischer-Tropsch (F-T) hydrocarbon products. A synthesis gas including carbon monoxide and hydrogen gas is provided to a F-T reactor. Also, acetylene is supplied to the F-T reactor. The molar ratio of the acetylene to that of the synthesis gas is about or more than 0.01. The synthesis gas and acetylene are reacted under suitable reaction conditions and in the presence of a F-T catalyst to produce F-T hydrocarbon products. The F-T hydrocarbon products are then recovered from the reactor. The synthesis gas and acetylene may be provided in a combined feed stream or introduced separately into the reactor. The catalyst ideally has an active catalyst component selected from at least one of the group consisting of Co, Ru, and Fe.

It is an object of the present invention to provide an acetylene enhanced syngas conversion in a F-T reactor which results in F-T products which have a tighter distribution of intermediate length carbon products than do F-T products synthesized according to conventional methods.

It is another object to provide a method for F-T conversion which utilizes an acetylene enhanced syngas feed wherein a lower percentage of methane is produced as compared to conventional F-T methods.

BRIEF DESCRIPTION OF THE DRAWINGS

These and other objects, features and advantages of the present invention will become better understood with regard to the following description, pending claims and accompanying drawings where:

DETAILED DESCRIPTION

Figure 1:
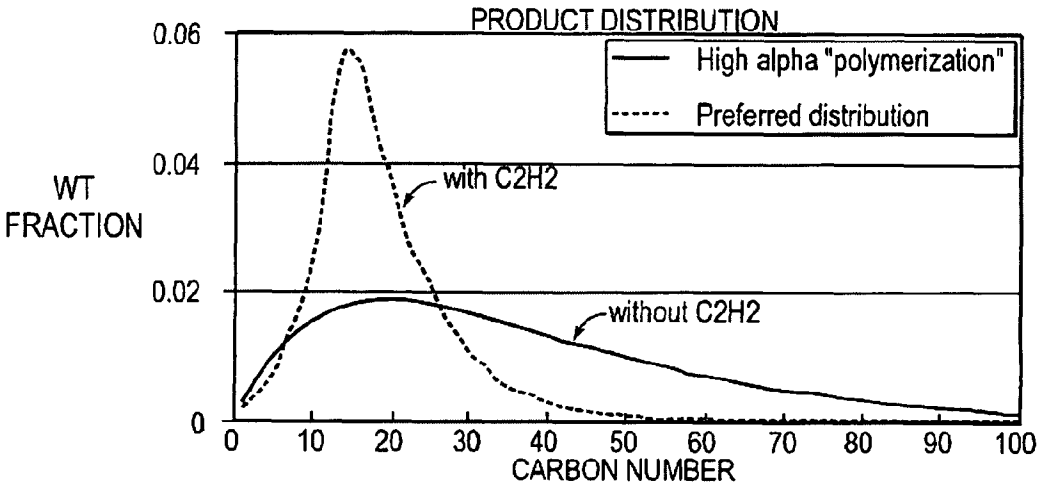
FIG. 1 is a hypothetical graph suggesting the contrast in product distributions by weight fraction versus carbon number for F-T products synthesized utilizing a syngas and acetylene feed and also utilizing a substantially acetylene free syngas feed.

The following description relates to the acetylene enhanced conversion of syngas to Fischer-Tropsch products. First, some theoretical considerations on how acetylene might contribute to the enhancement of F-T conversion of syngas to F-T products are offered. Next, an example is provided wherein a carbon containing product, such as natural gas, is converted to acetylene and syngas. The acetylene and syngas are then used in an acetylene enhanced conversion of the syngas into Fischer-Tropsch products. Details regarding process variables of the acetylene enhanced conversion of syngas into F-T products are then discussed. Finally, an experimental setup and results obtained from using that equipment in acetylene enhanced syngas conversions are described.

Surprisingly, a Fischer-Tropsch (F-T) conversion of syngas to hydrocarbon products can be effected, with the addition of sufficient amounts of acetylene and in the presence of an appropriate catalyst, to selectively enhance the production of medium chain length hydrocarbons while reducing the production of low and high end chain length hydrocarbons. The selected F-T catalyst ideally has a sufficient quantity of active sites to convert acetylene and carbon monoxide to medium chain length hydrocarbon products. For purposes of this application, low chain length can be considered as being $C_{1-5}$, medium chain length as $C_{6-20}$, and long chain lengths as $C_{20+}$.

Acetylene may be incorporated with a syngas feed supplied to a F-T reactor. Alternatively, the acetylene can be added directly to a F-T reactor, however separately from the syngas feed, in a manner to ensure acetylene is delivered throughout a catalyst bed. For example, a number of conduits (not shown) could be used to introduce acetylene at axially spaced apart locations of a cylindrical fixed bed F-T reactor.

Ideally, the catalyst used in the acetylene enhanced syngas conversion has sufficient active sites to catalyze or polymerize the synthesis gas (CO and $H_2$) and acetylene ($C_2H_2$) into hydrocarbon products of sufficient chain length such that a large portion of the F-T hydrocarbon products are liquid at ambient conditions, i.e., 1 atmosphere and 22° C., while ideally not producing significant amounts of waxy products, i.e., $C_{20+}$. Such a product can ideally be transported on a conventional transport ship at approximately the ambient conditions while remaining in a generally liquid or flowable state. While the F-T product is primarily liquid under such conditions and may contain some hydrocarbon gases and waxes, ideally would still be generally "pumpable" at the ambient conditions. The F-T products which are to be shipped should allow pumping without undue strain on the pumps and without plugging lines. Even if a F-T product is not collected from the F-T reactor which is "pumpable" at ambient temperatures, ideally the amount of wax produced is relatively small and therefore the amount of product that must hydrocracked or treated is much less than with the use of conventional F-T reactions which do not utilize acetylene enhancement.

In the presence of an appropriate F-T catalyst and under suitable reaction conditions, an advantageous distribution of hydrocarbon products can be produced relative to those hydrocarbon products produced by conventional F-T processes. First, with the presence of acetylenic compounds, chain growth predominantly starts with acetylene carbon length ($C_2$) thus reducing light hydrocarbon production. Performance benefits include higher per pass CO conversion, less methane byproduct, and a narrower molecular weight distribution of liquid products. Waxy F-T products are minimized with the increase in the formation of medium chain length hydrocarbons products. Such F-T products are generally flowable at ambient conditions, i.e., 1 atmosphere and moderate temperatures, i.e., 22° C. Because of the limited amount of waxy hydrocarbon products produced, hydrocracking may be limited or eliminated when using the present acetylene enhanced syngas conversion to hydrocarbon products as compared to conventional F-T processes.

1. Theoretical Background

While not wishing to be held to a particular theory, the following mechanisms are believed to be involved in acetylene enhanced syngas conversion to F-T hydrocarbon products. Acetylene competes very effectively with CO for active metal sites in F-T catalyst and the acetylene will start new hydrocarbon chains at $C_2$. Acetylene is much better at initiation of chains than CO so that F-T synthesis can be run at a much lower temperature when a sufficient amount of acetylene is present. The first step in the acetylene hydrogenation is to ethylene, which also builds into growing chains, although less strongly than the acetylene. Since chains starting at $C_2$ bypass the opportunity to form methane, acetylene boosts $C_{5+}$ production. A very small amount of the acetylene is believed to be converted to ethane with most building into $C_{3+}$ products.

Ethylene does the same, but as noted above, less strongly. It does not compete nearly as well for adsorption on the active metal surfaces and has no significant effect on the temperature at which the F-T reactions can be run. The presence of ethylene also boosts $C_{3+}$ product significantly. However, depending on its concentration, the $H_2$/CO ratio, temperature, etc., a large fraction of the ethylene may become hydrogenated to ethane. Ethane is generally inert in the F-T reaction and in a remote area, commercially has to either be recycled or used as a fuel. $C_2$ species have a very weak ability to add to growing chains. Thus, they act mainly as chain initiators. At very low CO concentrations, unsaturated $C_2$'s can dissociate into $C_1$ surface species, but this does not happen at normal F-T conditions. In both initiation and propagation steps, involvement by $C_2$'s increases the $C_{3+}$ formation rate, since twice as much carbon is being added. However, oligomerization and hydrogenation of the unsaturated $C_2$'s is much less exothermic than hydrogenation of CO. Also, competition by $C_2$ adsorption can actually lower the CO conversion rate. This competition results in a significant increase in $C_{5+}$ production with only a modest increase in heat released. This is advantageous in reactors that are already strained to control temperature.

Chain growth probability for heavier hydrocarbons is believed to be significantly reduced in the presence of acetylene and ethylene since they compete strongly with adsorption and chain initiation by heavier alpha-olefins. Consequently both the light end (methane) and the heavy end (wax) of the carbon number distribution for produced F-T products is diminished, leading to a higher selectivity for products which are liquids at 1 atmosphere and an ambient temperature of 22° C. Ethylene competes well for F-T sites because it has much less severe steric requirements—it lacks an alkyl group attached to the double bond. Acetylene does so for similar steric reasons, but is even more effective because the adsorption strength for its triple bond is much higher than that for ethylene's double bond. Higher selectivity to liquids, in addition to higher synthesis rates, means that liquid hydrocarbon formation is much faster when ethylene and acetylene are present.

Further, it is postulated that acetylene enhanced F-T conversions will cause the F-T produced hydrocarbons to contain more branched hydrocarbons than conventional F-T reactions which produce more straight chain F-T products. This branching makes the F-T products harder to organize in a crystalline fashion and form waxes. Thus F-T products of similar carbon chain lengths, but which are more branched, will still remain in a liquid state longer than unbranched chains of similar length.

FIG. 1 is a hypothetical graph suggesting the contrast in product distributions by weight fraction versus carbon number for F-T products synthesized utilizing (a) an acetylene enhanced syngas conversion and also utilizing (b) a substantially acetylene free syngas conversion. Note that the addition of acetylene is believed to sharply decrease the predominant range of carbon numbers from 1-100+ to approximately 5-20. This particular range of hydrocarbon products, i.e., $C_5$-$C_{20}$, is typically liquid at ambient temperatures and pressures, i.e. 22° C. and 1 atmosphere pressure. Accordingly, the amounts of gas products, $C_1$-$C_4$, and the amount of waxy or solid products, i.e., greater than $C_{20+}$, produced using the acetylene enhanced syngas conversion is hoped to be significantly reduced compared to products synthesized in conventional F-T reactions that do no use acetylene enhancement.

A greater percentage of the F-T products produced in the acetylene enhanced F-T reaction are liquids and fewer F-T products are solid or waxy as compared to conventional F-T conversions, when cooled to ambient conditions. Thus, a great majority of the F-T product is liquid and flowable at ambient conditions and can be transported, such as on marine vessels, without the inherent problems associated with transporting waxy or solid hydrocarbon F-T products.

Also, it appears that the relative rate of CO converted into hydrocarbons in each pass through the F-T reactor is greater with acetylene enhanced F-T reactions as opposed to non-enhanced conversions. Accordingly, the amount of $CH_4$ and CO which must be recycled in subsequent F-T passes is reduced.

Figure 2:
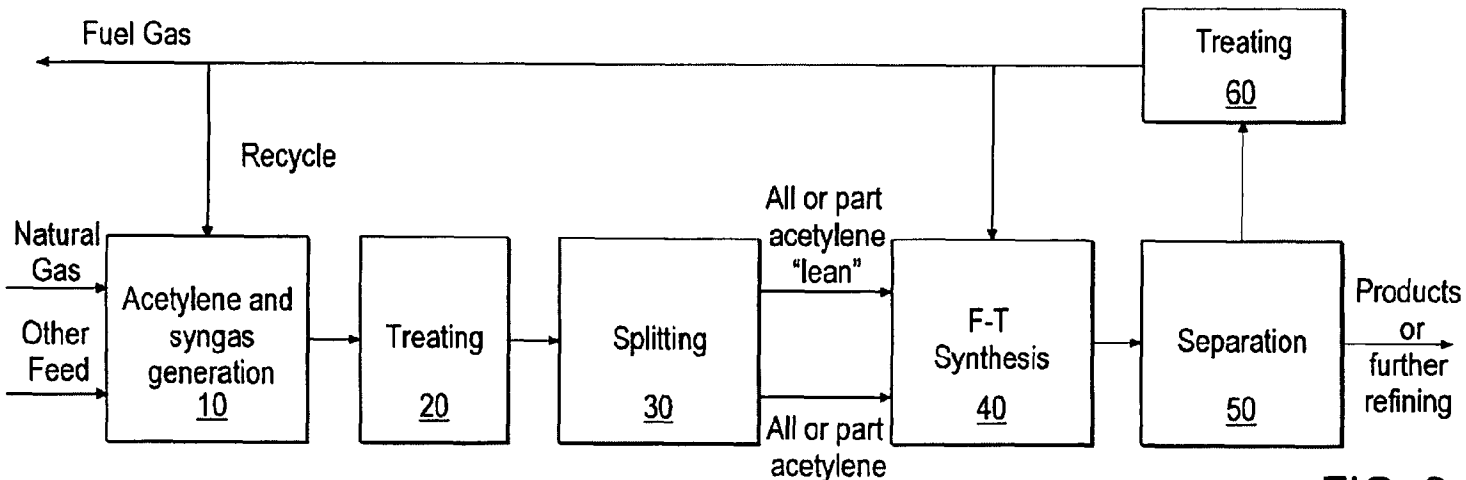
FIG. 2 illustrates a process diagram of steps showing a carbon containing product being converted into syngas, and ideally acetylene, with a syngas and acetylene feed then being introduced into a F-T reactor wherein an acetylene enhanced F-T reaction takes place producing F-T products which are lower in wax content than are F-T products from conventional F-T reactions.

2. Conversion of Carbon Containing Products to Liquid F-T Products Using Acetylene Enhanced Syngas Conversion FIG. 2 shows a process diagram for converting carbon containing products into F-T hydrocarbon products utilizing an acetylene enhanced syngas conversion. In step 10, natural gas and/or other feeds which are rich sources of carbon, are introduced into an acetylene and syngas generator which produces a first gaseous mixture including acetylene ($C_2H_2$) and syngas (CO and $H_2$).

Alternatively, the carbon containing products may first be converted into syngas with acetylene being added to the syngas at a later stage or else directly into the F-T reactor (not shown). Methods are known for converting coal and biomass into syngas. However, it is particularly desirable to convert natural gas to liquid hydrocarbons. This conversion allows hydrocarbons to be transported, such as in marine ships, in an energy efficient manner, without having to resort to liquefying or compressing the natural gas.

Acetylene can be made by the partial combustion of methane with oxygen or by the cracking of hydrocarbons. The generation of acetylene and syngas from methane is described in U.S. Pat. No. 4,726,913 to Brophy et al. which utilizes a spouted bed reactor. Furthermore, other known techniques can be found in the Encyclopedia of Chemical Technology, Acetylene, Volume 1, 3$^{rd}$ Edition, Wiley, New York, 1978. Those skilled in the art will appreciate there are numerous other well know means of making acetylene and syngas.

This gaseous mixture of syngas and acetylene and other byproducts may then be treated in step 20 to produce a second treated gaseous mixture comprising a more concentrated mixture of acetylene and syngas. Treatment of the product from the acetylene and syngas generator may include treating to remove contaminants or other undesirable products such as $CO_2$ and water.

The second treated mixture, or the untreated first mixture if no treating is deemed necessary, is then preferably split in step 30 into an acetylene "lean" mixture and an acetylene "rich" mixture. Acetylene "lean" means that there is insufficient acetylene and the mixture must have acetylene added to reach a desired concentration of acetylene in the mixture. Alternatively, if there is too much acetylene in the mixture, i.e. the mixture is too "rich", then acetylene must be removed from the mixture to achieve a desired concentration. The resulting acetylene/syngas feed ideally has molar ratio of greater than 0.01 of acetylene to syngas, more preferably, a molar ratio in the range of 0.011-0.10, and even more preferably a molar ratio from 0.020-0.040 or from about 0.03-0.04.

In step 40, a Fischer-Tropsch conversion is performed on the acetylene enhanced syngas mixture to produce a F-T product. In this particular embodiment, a conventional fixed bed Fischer-Tropsch reactor may be used for the conversion. In this example, ideally a cobalt based catalyst is used in the F-T reactor. The catalyst should contain an adequate supply of active sites to produce a significant distribution of hydrocarbons products in the range of $C_{5-20}$. The F-T hydrocarbon products produced generally have an enhanced distribution of medium chain length hydrocarbons and a reduced distribution of short-chain (gaseous) and long chain (waxy) hydrocarbons as compared to products produced by conventional F-T processes.

The F-T product produced in the F-T reactor is then separated in step 50 into a liquid F-T product and a gaseous F-T product. This is accomplished using a liquid trap which captures liquids while allowing tail gases to escape. Ideally, the captured liquid F-T product is sufficiently limited in long-chain or waxy product that the F-T liquid is flowable or pumpable at ambient temperatures, i.e. 22° C. For example, the F-T liquid product preferably has a cloud point of below 10° C. The F-T liquid product may then be placed in storage such as on a marine vessel for transport to a land based facility or else sent on for further processing and refining in a refinery.

The escaping tail gas F-T product or byproduct includes unreacted CO and $H_2$, ethane, ethylene, unreacted acetylene, $CO_2$, and traces of water vapor and $C_3$-$C_5$ hydrocarbons. Valuable products, such as $C_3$-$C_5$, may be separated from the rest of the tail gas and stored. The residual gaseous F-T product, including $C_1$-$C_2$, may then be reintroduced into the F-T reactor, or into the acetylene syngas generator, or else used as a fuel gas to generate heat.

3. Process Variables in Acetylene Enhanced Syngas Conversion (a) Relative Amounts of Acetylene:

In one embodiment of this acetylene enhanced syngas conversion, the molar ratio of acetylene introduced into the F-T reactor relative to the that of a syngas (CO and $H_2$) feed is >1-10%. In another embodiment, the range of acetylene used in the feed shall be 2-5% by molar ratio. In yet another embodiment, the amount of acetylene may range from 3-4% by molar ratio relative to the syngas feed. The acetylene may be included with the syngas feed to produce an acetylene enhanced syngas feed. Alternatively, the acetylene may be introduced in the F-T reactor separate and apart from the syngas. This allows portions of the total acetylene feed to be introduced into the F-T reactor over the length of the F-T reactor or at selected spaced apart locations. This overcomes the problem of all of the acetylene being consumed prior to reaching the downstream end of the F-T reactor, such as may occur in a cylindrical shaped fixed or packed bed F-T reactor.

(b) F-T Catalyst Type and Composition:

A cobalt based catalyst is an ideal catalyst to use in the F-T reactor. The cobalt catalyst should have a sufficient number of active sites to promote the growth of hydrocarbon products of significant medium chain length, i.e., $C_{5-20}$, without producing an oversupply of longer chain length products, i.e. $C_{20+}$. The cobalt based catalyst should contain cobalt and ideally have at least 100 μmol of surface metal sites per $cm^3$ of catalyst as measured by hydrogen chemisorption. In another example, the catalyst should ideally have at least 150 μmol of surface metal sites per $cm^3$ of catalyst. In yet another example, at least 200 μmol/$cm^3$ may be used.

For example, in an experimental test setup to be described below, the catalyst used was a pretreated 20 wt % Co-0.5 wt % Ru-1.0 wt % $La_2O_3$ on 78.5 wt % alumina catalyst which was mixed with inert α-alumina particles, which happens to have a similar size to the catalyst.

Alternatively, iron based catalysts may also be used. The catalysts are selected so that under suitable reaction conditions of temperature and pressure, the acetylene enhanced syngas conversion is converted primarily into liquid F-T products in the range $C_{3-20}$ while reducing the amount of short chain $C_{1-2}$ or "lights" and long chain ($C_{20+}$) or "heavy" F-T products.

(c) F-T Reactor Types

A variety of different types of F-T reactors may benefit utilizing acetylene enhanced syngas conversion. In a first embodiment, such as with the experimental set-up, the F-T reactor is a fixed or packed bed reactor. Alternatively, fluidized and spouted bed reactors may also be used. The use of a slurry bed F-T reactor is not as desirable since this type of reactor relies upon the use of waxy hydrocarbon products to operate and the production of the waxy products is desired to be limited or eliminated in the current F-T syngas conversion.

(d) Reactor Pressure:

Pressure can affect the carbon number distribution of the F-T product produced in the F-T reactor. In one embodiment, the acetylene pressure in the F-T reactor will stay at approximately 1 atmosphere with the overall pressure in the F-T reactor being held at 2-35 atmospheres. By way of example and not limitation, exemplary ranges of pressures at which a fixed bed reactor may be operated include 2-35 atmospheres, 20-30 atmospheres, 25-30 atmospheres and 10-20 atmospheres. Accordingly, with a 4% by volume of acetylene in an acetylene enhanced syngas feed, the exemplary overall pressure in the F-T reactor will be held at about 25 atmospheres. With a 3% by volume feed of acetylene, the overall pressure is might be maintained at about 33⅓ atmospheres.

(e) Reactor Operating Temperature:

Temperature is also believed to affect the chain length distribution of the F-T product produced in the F-T reactor. Ideally, the temperature will be held between 175-230° C. for a fixed bed reactor using a cobalt based catalyst. More preferably, the range of operating temperature would be between 190-210° C. If an iron (Fe) based catalyst is used, then the preferred temperature would be higher with a range of 240-270° C., and more preferably, between 250-260° C.

(f) $H_2$/CO Syngas Ratio:

The preferred range of $H_2$/CO to be fed to an F-T reactor is between 2.0:1 and 2.2:1 by volume. One $H_2$ per CO is used to convert the O to $H_2O$, another $H_2$ per CO is used to convert the C to —$CH_2$— groups in the interiors of hydrocarbon chains. Any additional $H_2$ per CO is need to saturate the end carbons of the hydrocarbons to $CH_3$ (methyl) groups. If these are not saturated and olefins are formed, then the usage ratio is $H_2$/CO=2. The $H_2$/CO ratio of the synthesis gas fed to the inlet of the reactor is preferably less than the usage ratio, however, in order to minimize methane formation. This is accomplished by operating at partial conversion with recycle of the dry gas after liquids (water and $C_5$+ hydrocarbons) products are removed by condensation. Consuming $H_2$ and CO at the usage ratio in the reactor will cause the recycle $H_2$/CO ratio to be lower than the inlet ratio, but that can be made up by blending the recycle flow with fresh feed that has the $H_2$/CO usage ratio. Varying the relative ratio of $H_2$/CO can be used to alter the chain length distribution produced in the F-T reactor, but lower ratios lead to reduced synthesis rates. Preferable inlet ratios are between 1.4 and 1.7, more preferably between 1.5 and 1.6, with per pass CO conversion near 50%.

(g) Alternative Components in Syngas Feed:

In addition to the acetylene and syngas in the feed, other components may be included, such as alpha-olefins. These components can initiate hydrocarbon chains on the catalysts leading to enhanced $C_{5+}$ paraffin and isoparaffin production.

(h) Residence Time in the F-T Reactor:

Residence time also affects the distribution of the F-T product produced in the F-T reactor. Residence time is the void volume in the catalyst bed divided by the volumetric flow rate corrected to the pressure and temperature at reaction conditions. It decreases as temperature goes up and increases as pressure increases. Sufficient residence time should be allowed to insure a high rate of conversion of the syngas to F-T hydrocarbon products. However, too much residence time may adversely effect the addition of acetylene by allowing the acetylene to break down without being sufficiently effective in altering the F-T distribution to limit the production of heavy hydrocarbon products. Ideally, the residence time is held between 1 seconds and 20 seconds, more preferably between 2 seconds and 10 seconds, and most preferably in the range of 3-5 seconds.

(i) F-T Product Characteristics:

Ideally, the non-gaseous or liquid oil portion of the captured F-T product is highly liquid at ambient conditions, i.e. a temperature of 22° C. and 1 atmosphere of pressure. While the liquid will contain dissolved hydrocarbon gases and liquids, ideally the liquid would be quite flowable or pumpable. By way of example and not limitation, the liquid oil product collected from the F-T reactor ideally has the following characteristics:

Pour Point Range: −5° C. to +5° C.

Wax Content Range: 0-10%

Carbon Distribution $C_5$-$C_{25}$

Cloud Point below 10° C.

4. Experimental Set-up

Figure 3:
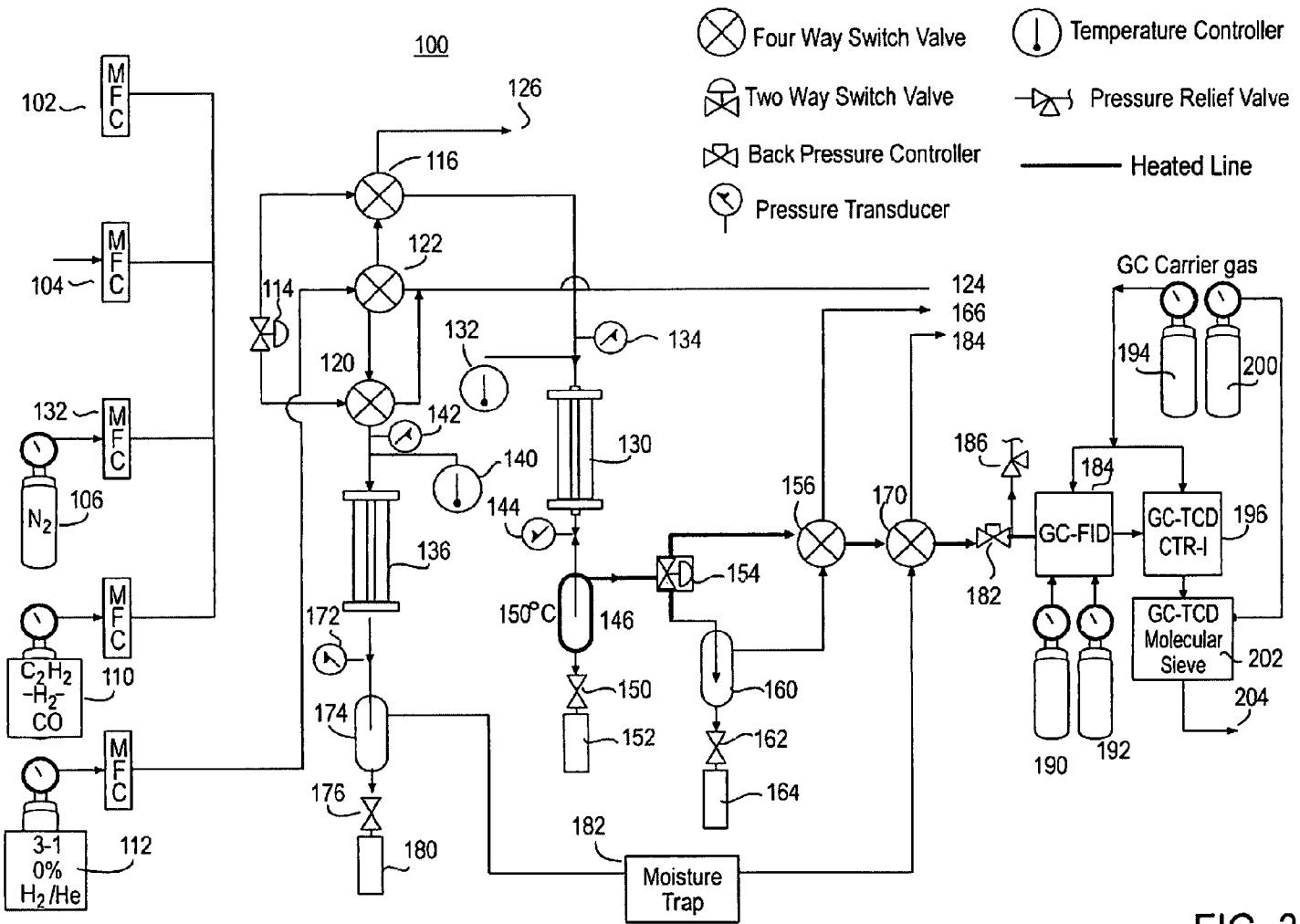
FIG. 3 shows an experimental setup for carrying out tests on acetylene enhanced syngas conversions.

FIG. 3 shows an experimental setup 100 used to examine process variables in an acetylene enhanced syngas conversion process. Feed gases are supplied by cylinders to F-T reactors which produce F-T hydrocarbon products. These products are separated into light tail gases ($C_1$-$C_2$ hydrocarbons, $CO_2$, unreacted CO and $H_2$), heavy tail gases ($C_3$-$C_4$ hydrocarbons), liquid hydrocarbons ($C_5$-$C_{20}$), oxygenates and water, and solid hydrocarbons ($C_{21}$+). Analysis equipment is used to investigate the composition of the F-T products.

With respect to supply cylinders of gas, cylinder 102 supplies carbon monoxide (CO). Cylinder 104 contains hydrogen gas ($H_2$). Nitrogen gas ($N_2$) is provided by cylinder 106 and can serve as a tracer. A mixture of acetylene ($C_2H_2$, ranging from 2 mol %-5 mol %), hydrogen gas ($H_2$) and carbon monoxide (CO), with $H_2$:CO ratio of 2.0 is supplied by cylinder 110. Finally, cylinder 112 contains a 3-10% mixture of hydrogen gas ($H_2$) and helium (He), which serves as a reducing gas to activate F-T catalysts. All gases are fed via Brooks 5850 mass flow controllers (MFC).

A two-way switching valve 114 fluidly connects cylinders 102, 104, 106 and 110 to either of two four-way switching valves, 116 or 120. Similarly, a four-way switching valve 122 fluidly connects cylinder 112 with a vent 124. Switching valve 116 can be adjusted to deliver gas to a vent 126 or else to the first F-T reactor 130 (a fixed-bed tubular reactor, 400 mm long and 80 mm diameter). A temperature controller 132 is used to control the temperature of a furnace that encloses this reactor. A thermocouple, which can move freely in a sheath mounted to the reactor, is used to monitor the temperature along the catalyst bed in reactor 130. Pressure transducers 134 and 144 measure the pressures at the top and bottom, respectively, of reactor 130. Four-way switching valve 120 alternatively connects with a vent 124 or else delivers gas to a second F-T reactor 136. Again, a temperature controller 140 and a pressure transducer 142 are placed upstream of second F-T reactor 136.

F-T products and effluents from reactor 130 pass through lines held at 150° C. to a hot trap or condenser 146. It is operated at approximately 120° C., and can capture output product from reactor 130, mainly waxes. A valve 150 can be opened to pass the waxy product to a sample vial 152. Output from reactor 130 goes to a two-way switch valve 154, that can route it directly to a four-way switching valve 156, or first through water trap 160 and then to valve 156. Water trap 160 allows liquid output, such as water and liquid hydrocarbons, by way of a valve 162, to be captured in a sample vial 164. Four-way switching valve 156 sends the vapor phase flow either to vent 166 or to another four-way switching valve 170.

F-T products and other effluents from the second F-T reactor 136 (also a fixed-bed tubular reactor, 400 mm long and 80 mm diameter) are routed past pressure transducer 172 via a heated line (at 120° C.) to product trap 174. That trap is maintained at room temperature. A valve 176 permits samples to be extracted from product trap 174 to a sample vial 180. Product trap 174 also connects to moisture trap 182 which, in turn, connects to four-way switching valve 170. A vent 184 may vent gases received from four-way switch 170. The purpose of valve 170 is to select one of the two vapor-phase product streams form the two F-T reactors for analysis in the analytical section.

Thus, four-way switching valve 170 is also connected through a back-pressure regulator 182 to a gas chromatograph-FID 184. Gas chromatograph 184 delivers light tail gas sample to gas chromatograph-TCD 196, which in turn, supplies gas chromatograph-TCD 202. Effluent from these gas chromatographs goes to vent 204. A pressure relief valve 186 allows pressure to be bled off from back-pressure controller 182. Cylinders 190 and 192, containing hydrogen gas ($H_2$) and compressed air, supply gas chromatograph 184. Cylinder 194 carries helium gas (He) and supplies carrier gas to gas chromatograph 184 and also to gas chromatograph-TCD 196. Argon, stored in cylinder 200, is connected to gas chromatograph 202.

Gas chromatograph-FID 184 (Shimadzu GC8A with FID detector and a Restek Rtx®-1, 60 m long, 0.53 mm internal diameter column) is utilized to analyze light hydrocarbons ($C_1$-$C_{12}$). Gas chromatograph-TCD 196 (Shimadzu GC8A with TCD detector and a CTR-I packed column) analyzes CO, $CO_2$, $C_2H_2$, $N_2$ and $CH_4$. Gas chromatograph 202 (Shimadzu GC8A chromatograph with a TCD detector and a 13× Molecular Sieve column) is used to measure the hydrogen ($H_2$) concentration.

Either first F-T reactor 130 or else second reactor 136 may be used in the acetylene enhanced syngas conversion of syngas to F-T products. In cases where it is suspected that waxes will be produced, first F-T reactor 130 is used in association with hot trap 146. If little or no significant amounts of waxy product ($C_{20+}$) is expected to be produced, then second F-T reactor 136 may be employed in F-T product synthesis.

Liquid products are identified off line by injection into a GC-MS (Shimadzu Model QP-5050 equipped with another Rtx®-1 capillary column, also 60 m long but of 0.25 mm diameter) for qualitative analysis and a GC-FID (Shimadzu GC-17 with a FID detector fitted with a Rtx®-1 capillary column, 60 m long and 0.25 mm diameter) for quantitative analysis.

A number of experiments were conducted with experimental setup 100.

A pretreated 20 wt % Co-0.5 wt % Ru-1.0 wt % $La_2O_3$ on 78.5 wt % alumina catalyst was mixed with inert α-alumina particles (which have similar size to the catalyst) and packed and supported between two quartz wool plugs in the test reactor. The pretreatment consisted of reducing the catalyst in flowing, 100% hydrogen while heating slowly (1° C./minute) to 350° C. and holding for at least 6 hours, cooling to ambient temperature, purging in nitrogen, passivating the catalyst in nitrogen-diluted air at ambient temperature, reoxidizing it by heating slowly to 300° C. in flowing air, cooling again, purging in nitrogen, then repeating the reduction and passivation steps. This makes the catalyst much easier to activate later in either diluted hydrogen or at lower temperature or both. The pretreatment was done outside the test reactor. The catalyst was reduced in the reactor in 10% $H_2/N_2$ at 300° C. for ca. 20 hr (by ramping temperature to 150° C. at 10° C./min and holding for 1 hour followed by increasing T° C. to 300° C. at 8° C./min and hold for 20 hours). The reactor temperature was then slowly decreased to room temperature in 10% $H_2/N_2$ stream. Before switching the blended $CO/H_2/N_2$ or $C_2H_2/CO/H_2/N_2$ gas mix to the reactor for normal F-T or acetylene enhanced F-T reaction, the inlet gas compositions of CO, $N_2$, $C_2H_2$ and $H_2$ were analyzed by bypassing the gas mix to GC 196 and GC 202, respectively. The F-T synthesis was initialized by switching the inlet gas to reactor (130 or 136) and slowly ramping the temperature (at a rate of 5° C./min) and pressure to determined values. After the F-T reaction reached a steady state after 2 hours, analytic measurements were taken every 1-2 hours. During the reaction, online gas analyses were conducted via GC-FID (184), GC-TCD (196) and GC-TCD (202) for $C_1$-$C_{12}$ light hydrocarbons, CO, $CO_2$, $N_2$, $C_2H_2$, $CH_4$ and $H_2$, respectively. The liquid product collected was analyzed quantitatively and qualitatively offline, using GC-FID and GC-MS for condensed high hydrocarbons ($C_{5+}$) and oxygenates.

The following exemplary range of process variables might be used in the experimental setup 100. In commercial set ups, of course, a broader range of the process variables can be practiced, as described elsewhere in this specification.

| | |
|---|---|
| F-T reaction temperatures: | 190-210° C. |
| Acetylene content: | 0-3.8% (vol.) |
| $H_2$:CO ratio: | 2.0-2.3 |
| F-T reactor pressure: | 5, 10, 20 atmospheres; |
| Catalyst loading: | 1 gram/cubic centimeter of reactor void; |
| Total inlet gas flowrate: | 60-120 mL/min; |
| Reaction time: | 18-48 hours; |
| Analysis performed online: | |
| (2) Tail Gas (GC-TCD) | CO, $CO_2$, $N_2$, $H_2$, $CH_4$ and $C_2H_2$ |
| GC-FID (Rtx-1 capillary Column) | $C_1$-$C_{12}$ |
| Offline Liquid product analysis: | |
| GS-MS (Shimadzu Model QP-5050) | qualitative analysis |
| GC-FID (Shimadzu GC-17) | quantitative analysis |

5. Examples

Comparative Example 1

A first, generally acetylene free run was made utilizing the experimental test setup 100 above. The process variables for this particular run are shown in the below table:

TABLE 1

Baseline Conditions

| | |
|---|---|
| Acetylene (dry Volume %) | 0 |
| Catalyst | 1 gram |
| Reactor Temperature | 210 |
| Reactor Pressure | 5 atm |
| $H_2$/CO ratio | 2.0 |
| Residence Time | 144 mmol/h/$g_{catalyst}$ |
| Reaction Time | 5 hours |

Figure 4:
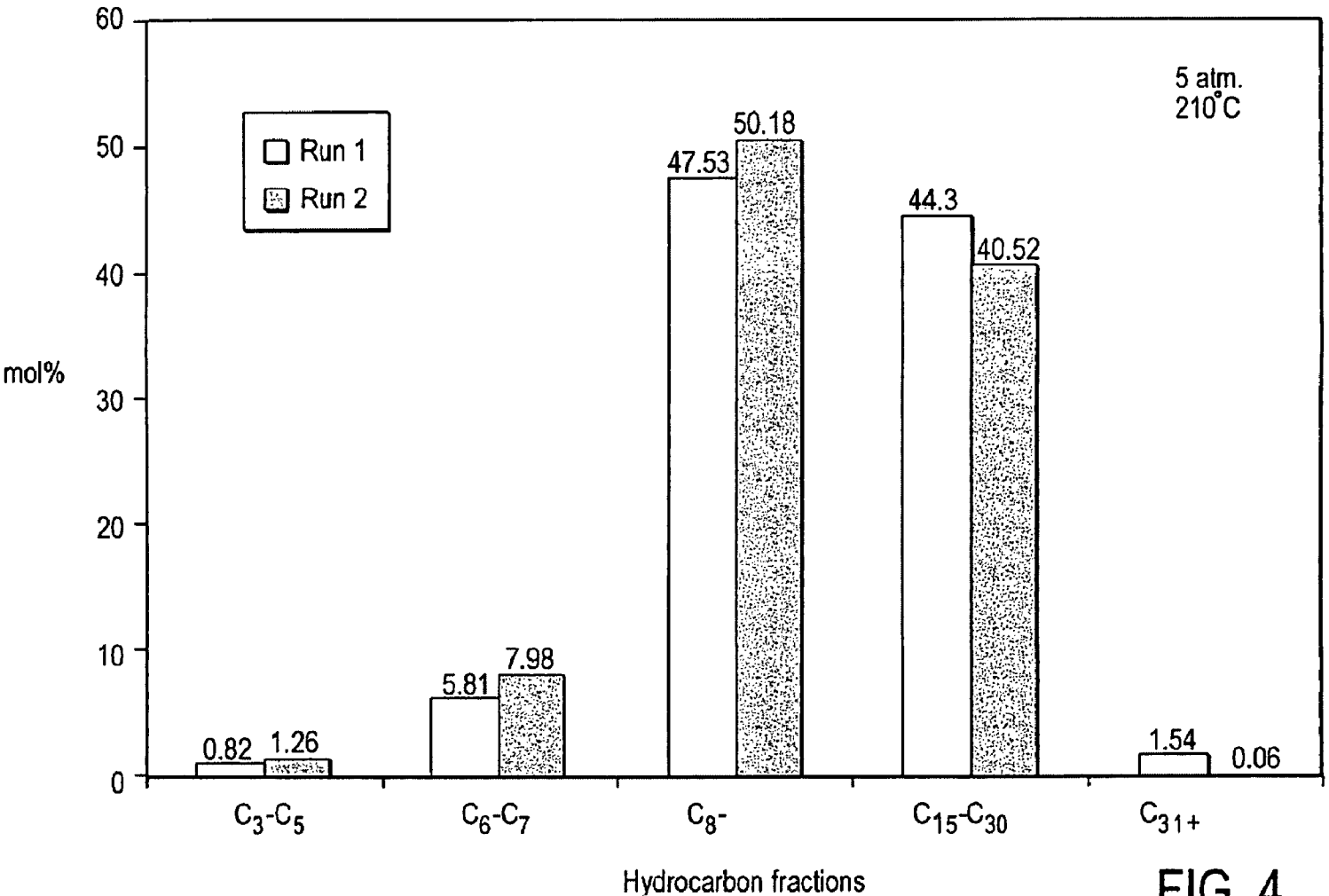
FIG. 4 is a bar graph showing a comparison between hydrocarbon distributions in oil products produced from F-T conversions using an acetylene free syngas feed (Run 1) and an acetylene enhanced syngas feed (Run 2) made at 5 atmospheres of pressure and at a temperature of 210° C.

Results:

The conversions of CO and hydrogen were about 60% and 65%, respectively, at these conditions. The carbon number distribution of the F-T product oil from the reactor is shown in FIG. 4. Note that the relative amount of long-chain product, i.e., with a carbon number 15 or greater, was significant, comprising approximately 46 carbon mole percent.

Figure 5:
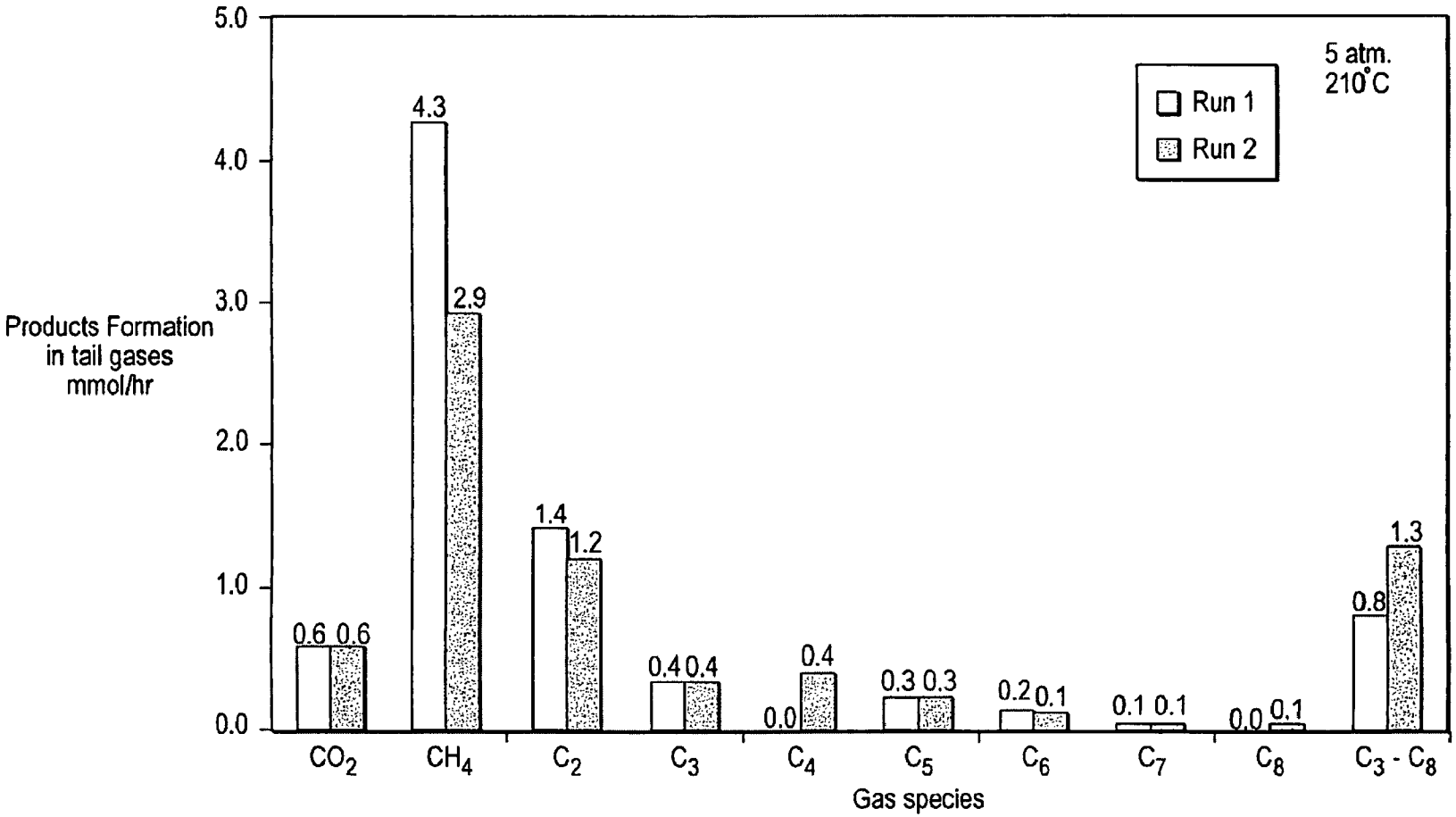
FIG. 5 is a bar graph showing a comparison of tail gas compositions between F-T products produced from a syngas feed with acetylene (Run 2) and a syngas feed without acetylene (Run 1) at 5 atmosphere of pressure and at a temperature of 210° C.

FIG. 5 shows that the formation rate of methane in the tail gas was 4.3 mmol/hr.

Figure 6:
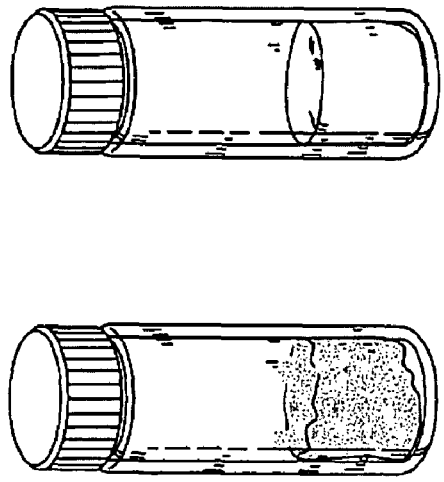
FIG. 6 provides a visual comparison between oil products made in two F-T reaction runs without and with acetylene (1.61%) syngas feeds made at 5 atmospheres of pressure and at a temperature of 210° C.

FIG. 6 illustrates that when there was no appreciable acetylene in the syngas feed, the degree of conversion is moderate and the resulting oil liquid was waxy and white opaque.

Example 2

A second run was performed which included acetylene augmenting the syngas in the input feed to the F-T reactor. The percentage of acetylene was 1.61% by dry volume in the feed. The other process variables were identical to that of comparative example 1.

Results:

The CO and hydrogen conversions were 55% and 70%, respectively, while the acetylene conversion was 100%. The carbon number distribution of the F-T product oil from the reactor is shown in FIG. 4. There was relatively more $C_6$-$C_{14}$ product, relatively less $C_{15}$-$C_{30}$, and only traces of hydrocarbons with chain length greater than $C_{30}$. Note that the resulting F-T oil product is then clear rather than cloudy, as seen in FIG. 6. Further, looking to FIG. 5, note that the formation rate of methane in the tail gas has dropped from 4.3 mmol/hr to 2.9 mmol/hr, a decrease of approximately 30%.

Example 3

Effect of Acetylene Concentration on F-T Product Distribution at 5 atm and 190° C.

A study on the effect of acetylene concentration on F-T product distribution was carried out for over 20 hours according to the process conditions shown in the below table:

TABLE 2

Effect of Acetylene Concentration

| Run | Temperature, ° C. | Pressure, atm | Reaction time, hr | Acetylene, mol % | $H_2$:CO molar ratio | Space Velocity (F/W), mmol/h/$g_{cat}$ |
|---|---|---|---|---|---|---|
| FT | 190 | 5 | 20 | 0 | 2.0 | 170 |
| FTA-1.55% C2H2 | 190 | 5 | 20 | 1.55 | 2.15 | 170 |
| FTA-3.25% C2H2 | 190 | 5 | 21 | 3.25 | 2.2 | 180 |
| FTA-3.8% C2H2 | 190 | 5 | 22 | 3.80 | 2.2 | 185 |

Figure 7:
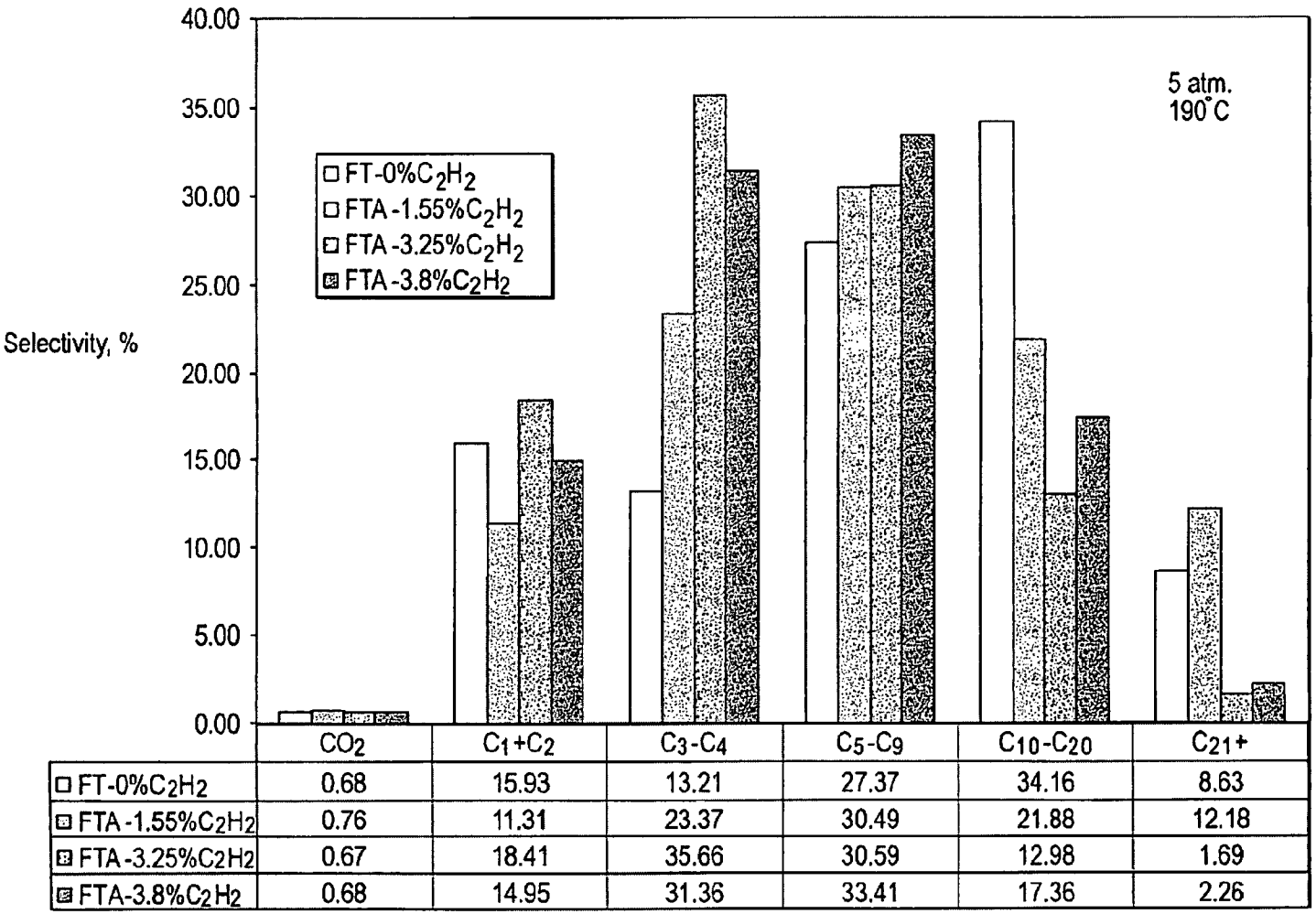
FIG. 7 is a bar graph which shows the effect of acetylene concentration in F-T syngas feeds on product selectivity at 5 atmospheres of pressure and at a temperature of 190° C.

The CO conversions in these runs were 16.4, 16.8, 22.2 and 26.8%, respectively. FIG. 7 shows the product selectivities to carbon containing species during the F-T reaction without and with various concentrations of acetylene in the feed.

It is apparent that the $C_3$-$C_4$ fraction in the gas phase increased after introducing acetylene into the F-T reaction. Adding 1.55% $C_2H_2$ to F-T feed, the liquid hydrocarbons shifted from $C_{10}$-$C_{20}$ to $C_5$-$C_9$ and $C_{21+}$ wax fractions. However, when the acetylene in the feed was 3.25% or higher, the formation of the $C_{21+}$ wax fraction was significantly reduced. For example, the run adding 3.25% $C_2H_2$ to F-T feed resulted in liquid product produced with less than 2% of the $C_{21+}$ wax fraction, i.e., 1.69%. The run adding 3.8% $C_2H_2$ to F-T feed produced a liquid product with less than 3% of the $C_{21+}$ wax fraction, i.e., 2.26%. The resulting oil products were clear liquids with few visible grains of white wax solids. It is desirable to have $C_{21+}$ wax fraction of less than 10%, or 5% or 3% or even 2%.

Figure 8:
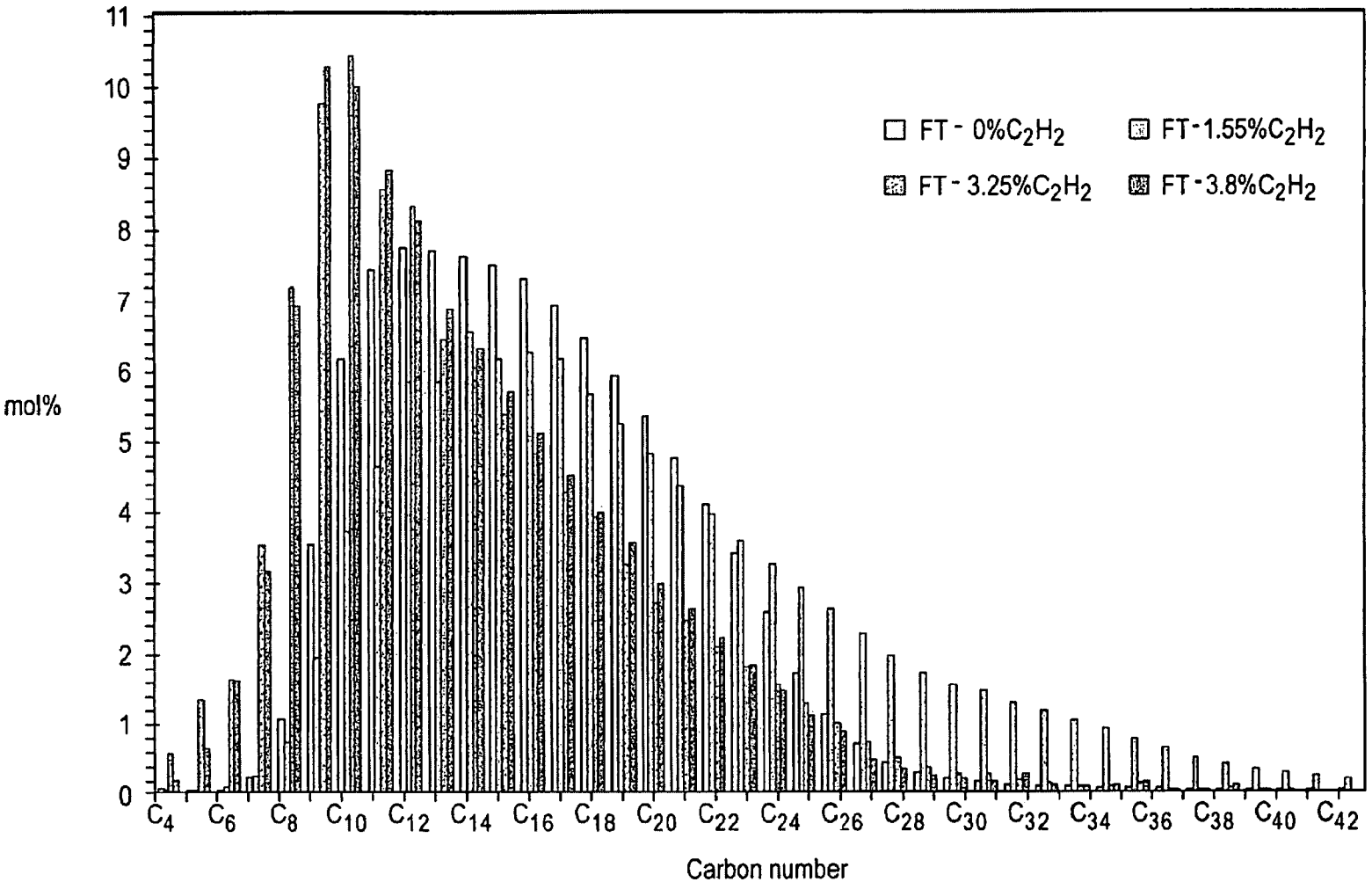
FIG. 8 is a bar graph showing a comparison of carbon number distribution in oil products from F-T reactions made with and without adding acetylene to a syngas feed at 5 atmospheres of pressure and at a temperature of 190° C.

FIG. 8 shows the carbon number distribution of the oil products in these four runs. It clearly illustrates a shift towards heavier hydrocarbons at 1.55% acetylene in the feed, but a shift to lighter hydrocarbons when the inlet acetylene concentrations in the F-T feed exceeded 3 vol %.

While in the foregoing specification this invention has been described in relation to certain preferred embodiments thereof, and many details have been set forth for purpose of illustration, it will be apparent to those skilled in the art that the invention is susceptible to alteration and that certain other details described herein can vary considerably without departing from the basic principles of the invention.

What is claimed is:

1. A method for converting syngas to Fischer-Tropsch (F-T) hydrocarbon products with minimal amounts of wax, the method comprising:

(a) providing synthesis gas to a F-T reactor;

(b) providing acetylene to the F-T reactor, the molar ratio of the acetylene to synthesis gas being 2-5%;

(c) reacting the synthesis gas and acetylene under suitable reaction conditions, in the presence of a catalyst, to produce F-T hydrocarbon products having a wax fraction $C_{21+}$ of less than 5%, and (d) recovering the F-T products having the wax fraction $C_{21+}$ of less than 5%.

2. The method of claim 1, wherein the molar ratio of the acetylene to synthesis gas is 2-4%.

3. The method of claim 1, wherein the molar ratio of the acetylene to synthesis gas is 3-4%.

4. The method of claim 1, further comprising providing the synthesis gas and the acetylene to the F-T reactor in the same feedstream.

5. The method of claim 1, further comprising providing the synthesis gas and the acetylene to the F-T reactor in separate feedstreams.

6. The method of claim 1, wherein the catalyst contains cobalt and has at least 100 μmol of surface metal sites per $cm^3$ of catalyst as measured by hydrogen chemisorption.

7. The method of claim 1, wherein the F-T reactor is operated at between 5-35 atmospheres of pressure.

8. The method of claim 1, further comprising operating the F-T reactor between 180-220° C.

9. The method of claim 1, further comprising condensing the recovered F-T products to a temperature below 40° C. and recovering a gas and an oil product at 1 atmosphere pressure.

10. The method of claim 9, wherein the oil product has a cloud point of below 25° C.

11. The method of claim 9, wherein the oil product has a pour point below 5° C.

12. The method of claim 1, wherein the F-T hydrocarbon products have a wax fraction $C_{21+}$ of less than 3%.

13. The method of claim 1, wherein the F-T hydrocarbon products have a wax fraction $C_{21+}$ of less than 2%.

14. The method of claim 1, wherein the F-T hydrocarbon products produced are primarily $C_{5-20}$.

15. A method for converting syngas to Fischer-Tropsch (F-T) hydrocarbon products with minimal amounts of wax, the method comprising:

(a) providing synthesis gas and acetylene to a F-T reactor, the molar ratio of the acetylene to synthesis gas being 2-5%;

(b) reacting the synthesis gas and acetylene under suitable reaction conditions, in the presence of a catalyst, to produce F-T hydrocarbon products having a wax content of 0 to 10%;

(c) recovering the F-T products having the wax content of 0-10% and having a pour point of −5° C. to +5° C., a cloud point of below 10° C. and being pumpable at ambient temperature.

16. The method of claim 15, wherein the molar ratio of the acetylene to synthesis gas is 2-4%.

17. The method of claim 15, wherein the molar ratio of the acetylene to synthesis gas is 3-4%.

18. The method of claim 15, further comprising providing the synthesis gas and the acetylene to the F-T reactor in the same feedstream.

19. The method of claim 15, further comprising providing the synthesis gas and the acetylene to the F-T reactor in separate feedstreams.

20. The method of claim 15, wherein the F-T hydrocarbon products produced are primarily $C_{5-25}$.

* * * * *